US005125390A

United States Patent [19]

Riehl

[11] Patent Number: 5,125,390

[45] Date of Patent: Jun. 30, 1992

[54] COOKING APPARATUS, BURNER CONSTRUCTION THEREFOR AND METHODS OF MAKING THE SAME

[75] Inventor: Fred Riehl, Greensburg, Pa.

[73] Assignee: Robertshaw Controls Company, Richmond, Va.

[21] Appl. No.: 786,182

[22] Filed: Oct. 31, 1991

[51] Int. Cl.[5] ..... F24C 3/00

[52] U.S. Cl. ..... 126/39 R; 126/39 H; 431/266

[58] Field of Search ..... 126/39 R, 39 B, 39 H, 126/39 N; 431/266

[56] References Cited

U.S. PATENT DOCUMENTS

| | | | |
|---|---|---|---|
| 4,846,671 | 7/1989 | Kwiatek | 431/266 |
| 5,002,038 | 3/1991 | Riehl | 126/39 R |
| 5,040,970 | 8/1991 | Riehl | 431/264 |

FOREIGN PATENT DOCUMENTS

| | | | |
|---|---|---|---|
| 1096960 | 2/1955 | France | 126/39 I |

*Primary Examiner*—Carroll B. Dority
*Attorney, Agent, or Firm*—Candor, Candor & Tassone

[57] ABSTRACT

A cooking apparatus, a burner construction therefor and methods of making the same are provided, the cooking apparatus comprising a frame unit having a top surface unit provided with an opening passing therethrough, and a burner construction carried by the frame unit so that the burner construction projects out of the opening above the top surface unit, the burner construction comprising a first portion that extends above the top surface unit, the first portion having a chamber therein and having ports out of which fuel can issue from the chamber to burn externally to the first portion above the top surface unit, the burner construction comprising a second portion that extends below the top surface unit and has structure for interconnecting with a fuel source conduit and for delivering fuel therefrom to the chamber, the first portion and the second portion being separate parts respectively having first structure interconnecting the same together in one of a plurality of selectable rotational positions therebetween, the second portion and the frame unit respectively having second structure interconnecting the same together in one of a plurality of selectable rotational positions therebetween.

20 Claims, 10 Drawing Sheets

COOKING APPARATUS, BURNER CONSTRUCTION THEREFOR AND METHODS OF MAKING THE SAME

BACKGROUND OF THE INVENTION

1. Field of the Invention

This invention relates to a new cooking apparatus and to a new burner construction therefor as well as to new methods of making such a cooking apparatus and such a burner construction.

2. Prior Art Statement

It is known to provide a cooking apparatus comprising a frame means having a top surface means provided with an opening means passing therethrough, and a burner construction carried by the frame means so that the burner construction projects out of the opening means above the top surface means, the burner construction comprising a first portion that extends above the top surface means, the first portion having a chamber means therein and having a port means out of which fuel can issue from the chamber means to burn externally to the first portion above the top surface means, the burner construction comprising a second portion that extends below the top surface means and has means for interconnecting with a fuel source conduit means and for delivering fuel therefrom to the chamber means. For example, see the U.S. Pat. No. 5,002,038 to Riehl; the U.S. Pat. No. 5,040,970 to Riehl, and the U.S. Pat. No. 4,846,671 to Kwiatek.

SUMMARY OF THE INVENTION

It is one of the features of this invention to provide a new cooking apparatus wherein a burner construction thereof provides unique installation flexibility by permitting the same to have various parts thereof disposed in one of a plurality of selectable rotational positions so as to simplify the inherent problems of the installation plumbing, electrical wiring and general appliance assembly.

In particular, it was found according to the teachings of this invention that a burner construction can be formed of two separate portions, one of which extends above the top surface means of the cooking apparatus and the other of which extends below that top surface means and has means for interconnecting with a fuel source conduit means and for delivering fuel therefrom to the first portion so as to issue out of port means thereof to burn externally to the first portion and above the top surface means.

It was further found according to the teachings of this invention that the first portion and the second portion of the burner construction can have means for interconnecting the same together in any one of a plurality of selectable rotational positions therebetween so as to select the position of the igniter assembly that is carried by the first portion relative to the frame means of the cooking apparatus.

In addition, it was found according to the teachings of this invention that the second portion of the burner construction and the frame means of the cooking apparatus can respectively have means for interconnecting the same together in any one of a plurality of selectable rotational positions therebetween so as to select the desired position of the means of the second portion for interconnecting with a fuel source conduit means of the cooking apparatus.

For example, one embodiment of this invention comprises a cooking apparatus comprising a frame means having a top surface means provided with an opening means passing therethrough, and a burner construction carried by the frame means so that the burner construction projects out of the opening means above the top surface means, the burner construction comprising a first portion that extends above the top surface means, the first portion having a chamber means therein and having port means out of which fuel can issue from the chamber means to burn externally to the first portion above the top surface means, the burner construction comprising a second portion that extends below the top surface means and has means for interconnecting with a fuel source conduit means and for delivering fuel therefrom to the chamber means, the first portion and the second portion being separate parts respectively having first means interconnecting the same together in one of a plurality of selectable rotational positions therebetween, the second portion and the frame means respectively having second means interconnecting the same together in one of a plurality of selectable rotational positions therebetween.

Accordingly, it is an object of this invention to provide a new cooking apparatus having one or more of the novel features of this invention as set forth above or hereinafter shown or described.

Another object of this invention is to provide a new method of making such a cooking apparatus, the method of this invention having one or more of the novel features of this invention as set forth above or hereinafter shown or described.

Another object of this invention is to provide a new burner construction having one or more of the novel features of this invention as set forth above or hereinafter shown or described.

Another object of this invention is to provide a new method of making such a burner construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
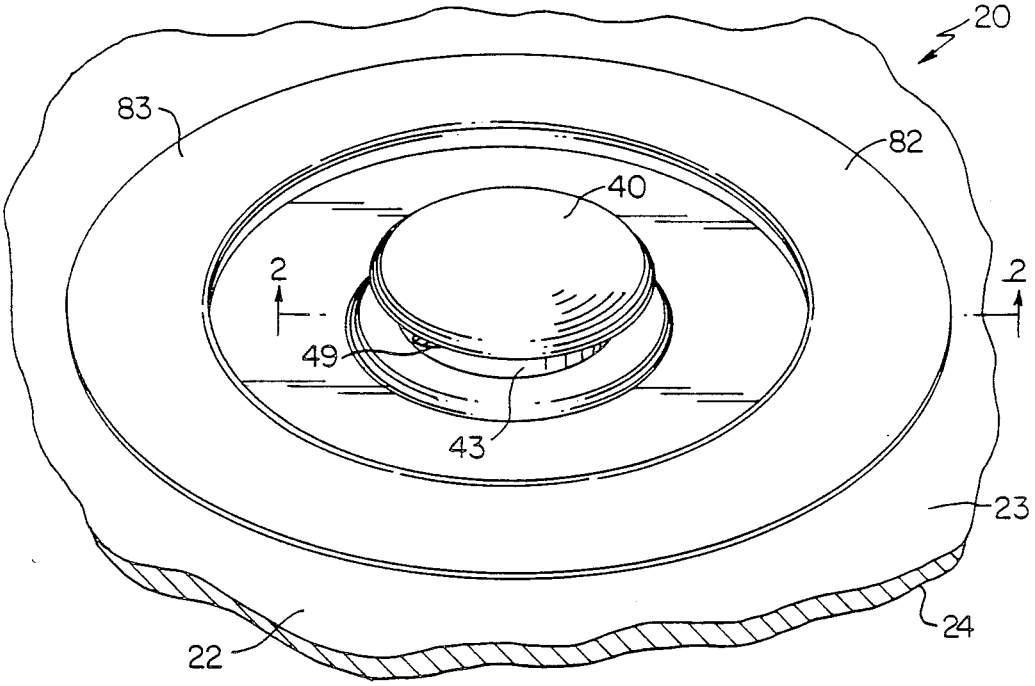
FIG. 1 is a top fragmentary perspective view of a new cooking apparatus of this invention and illustrates a new burner construction of this invention assembled to a top surface means of the cooking apparatus and with its associated cooking grate removed.

While the various features of this invention are hereinafter illustrated and described as being particularly adapted to provide a burner construction for a top surface means of a cooking apparatus, it is to be understood that the various features of this invention can be utilized singly or in various combinations thereof to provide a burner construction for other apparatus as desired.

Therefore, this invention is not to be limited to only the embodiments illustrated in the drawings, because the drawings are merely utilized to illustrate one of the wide variety of uses of this invention.

Figure 2:
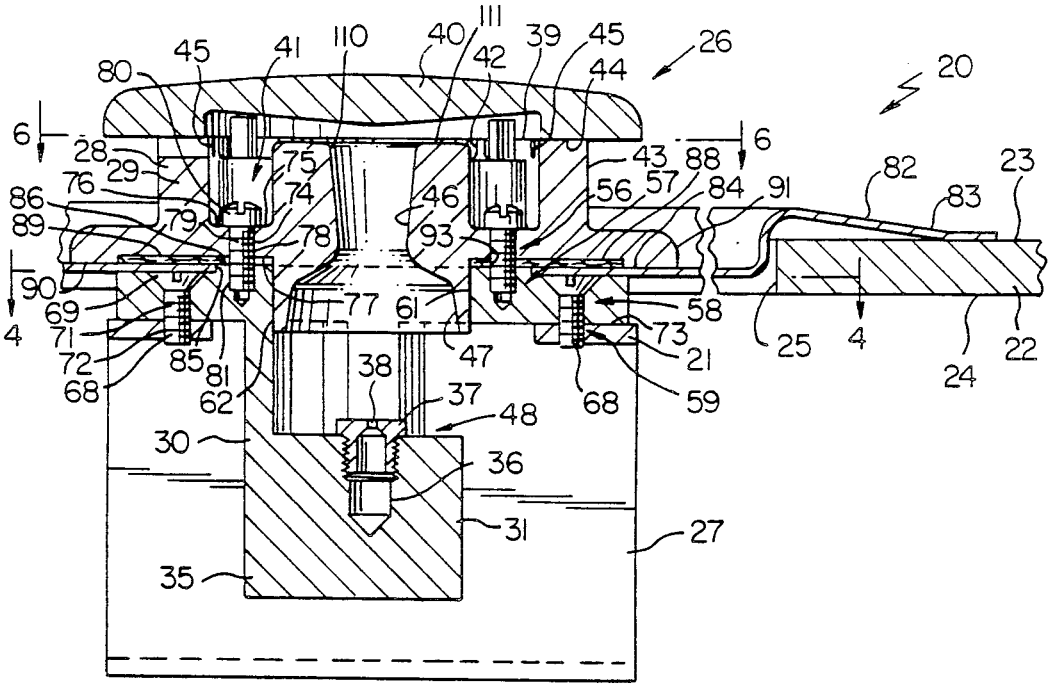
FIG. 2 is an enlarged fragmentary cross-sectional view taken on line 2—2 of FIG. 1.

Referring now to FIGS. 1 and 2, a new cooking apparatus of this invention is generally indicated by the reference numeral 20 and comprises a frame means 21 that has a top surface means 22 provided with a top surface 23 and a lower surface 24 and through which a substantially circular opening means 25 passes and in which a new burner construction of this invention is uniquely mounted and is generally indicated by the reference numeral 26.

The burner construction 26 of this invention comprises a sealed burner construction and functions substantially in the same manner as the sealed burner constructions set forth in applicant's aforementioned U.S. Pat. Nos. 5,002,038 and 5,040,970 whereby these two U.S. patents are being incorporated into this disclosure by this reference. thereto.

Therefore, since the reasons for the use of a sealed burner construction and the operation thereof are facts that are well known in the art, only the details of the sealed burner construction 26 that are believed to be necessary to understand the various features of this invention will now be set forth.

The burner construction 26 of this invention comprises a burner body means 28 that comprises a first portion 29 that projects out of the opening means 25 of the top surface means 22 and comprises a second portion 30 that extends below the top surface means 22 and has means 31 for interconnecting to a fuel source conduit 32 that is disposed within and carried by the cooking apparatus in a manner well known in the art, the conduit means 32 having a rotatable and threaded coupling means 33 that is adapted to thread into a threaded opening 34 of a lower part 35 of the portion 30 and interconnect with a passage means 36 thereof that leads to an orifice member 37 for issuing the fuel received from the conduit means 32 out of an orifice opening thereof in a manner well known in the art.

The first portion 29 and second portion 30 of the burner body means 28 of the burner construction 26 comprise separate parts that are uniquely interconnected together in a manner hereinafter set forth.

The first portion 29 of the burner body means 28 of the burner construction 26 has an open end that is adapted to be closed by a removable cap means 40 normally disposed on the open end 39 to cooperate therewith to not only define a chamber means 41 within the burner construction 26 but also to cooperate with a plurality of U-shaped grooves 42 formed in an annular surface means 43 of the portion 29 to close the same with an annular surface means 44 thereof so as to define port means 45 leading from the chamber means 41 of the burner construction 26 to the exterior thereof for issuing fuel that is adapted to burn externally of the burner construction 26 above the top surface means 22 for cooking purposes and the like.

The fuel is delivered from the fuel conduit means 32 into the chamber means 41 of the burner construction 26 by first passing through a venturi section 46 of the first portion 29 that has an opening 47 spaced above the orifice 38 of the orifice cup 37 so as to permit are to be entrained therewith by being drawn through suitable opening means 48 formed in the second portion 30 in a manner similar to the burner constructions set forth in the aforementioned U.S. Pat. Nos. 5,002,038 and 5,040,970 to Riehl.

The first portion 29 of the body means 28 of the burner construction 26 has an igniter assembly 49 carried thereby, the igniter assembly 49 comprising an electrically insulating part 50 disposed in a substantially rectangular opening 51 formed in the annular surface 43 of the portion 29 and having a lower end 51' projecting downwardly through an associated triangular slot means or notch 52 of the second portion 30 in the manner illustrated in FIGS. 4 and 5 and hereinafter described.

The igniter assembly 49 includes an electrically conductive electrode member 53 that has an upper end 54 that projects out of the part 50 thereof for sparking to the cap means 40 to ignite the fuel issuing out of the port means 45 in substantially the same manner as set forth in the aforementioned U.S. Pat. No. 5,040,970 to Riehl, whereby a further description of the details and operation of the igniter assembly 49 is deemed unnecessary except to state that it can be seen that the igniter assembly 49 is carried with the first portion 29 of the body means 28 of the burner construction 26 so as to be movable in unison therewith relative to the second portion 30 as will be apparent hereinafter.

While the parts 29, 30 and 40 of the burner construction 26 can be formed of any suitable material, such as metallic material, the parts 29 30 and 40 in one working embodiment of this invention are each formed of die cast aluminum RMS-105.

The first portion 29 of the burner body means 28 has a first means that is generally indicated by the reference numeral 56 that is adapted to interconnect with a first means 57 of the second portion 30 in a manner hereinafter described in any one of a plurality of selectable rotational positions therebetween.

In a similar manner, the second portion 30 has a second means 58 that is adapted to cooperate with a second means 59 of the frame means 21 to interconnect the second portion 30 of the burner construction 26 to the frame means 21 in any one of a plurality of selectable rotatable positions therebetween as will be hereinafter set forth.

Figure 3:
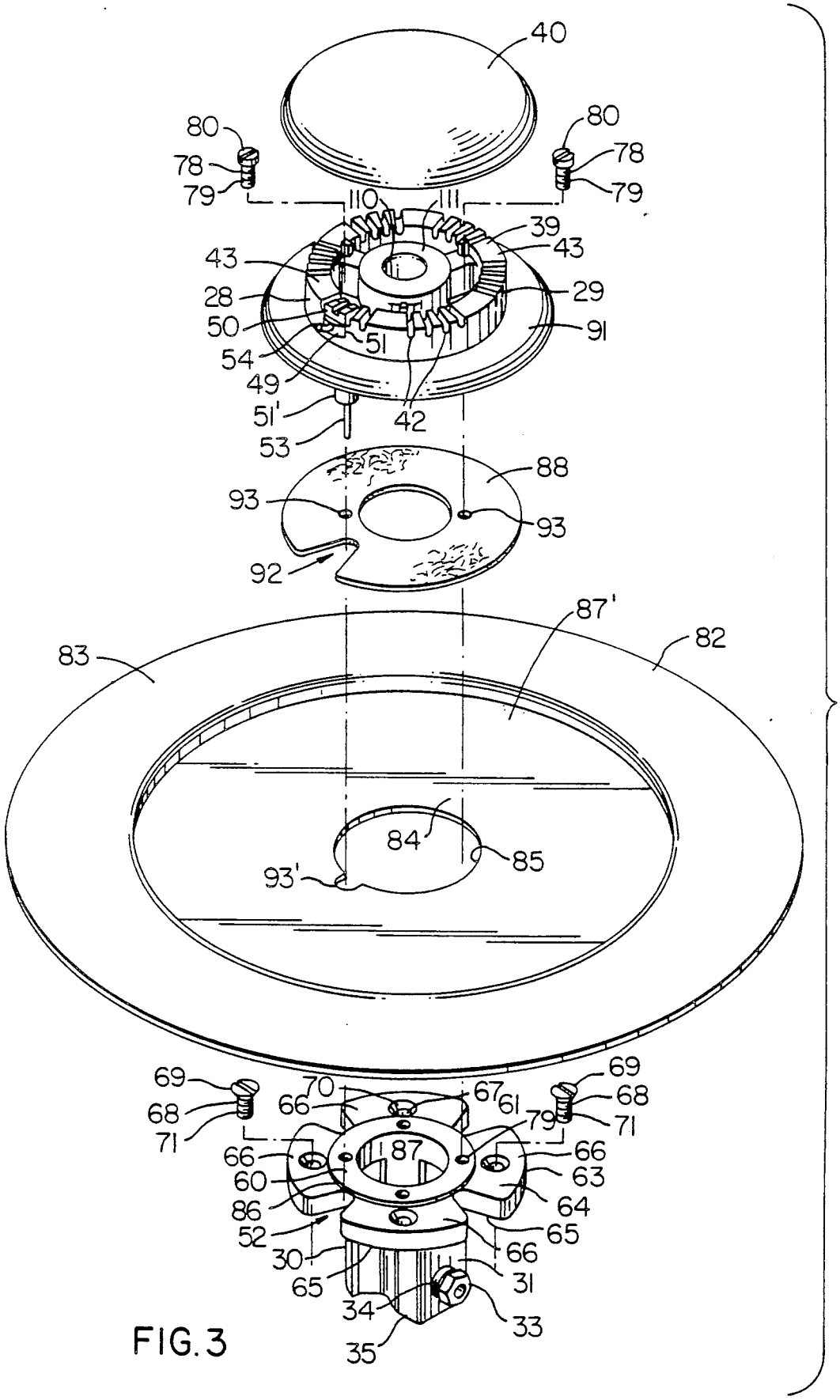
FIG. 3 is an exploded perspective view of the various parts of the burner construction of FIGS. 1 and 2 together with an annular flange means of the cooking apparatus.

The portion 30 of the burner construction 26, as best illustrated in FIG. 3, has an upper surface means 60 interrupted by a substantially cylindrical opening means 61 that leads to the orifice member 37 and interconnects with the opening means 48 thereof, the cylindrical opening means 61 being adapted to telescopically receive a cylindrical part 62 of the first portion 29 in the manner illustrated in FIG. 2 when the portions 29 and 30 are assembled together.

The portion 30 of the burner construction 26 comprises an annular flange-like structure or wall means 63 that is stepped below the annular surface means 60 and having an upper surface means 64 and a lower surface means 65 with the V-shaped notches or slot means 52 being formed therein in a circular array and being equally spaced apart so that four such slots 52 are provided in the wall means 63 to define four like flange parts or wings 66 each having an opening means 67 passing therethrough. Each opening means 67 is adapted to receive a threaded fastening member 68 therein so that an enlarged head 69 of the fastening member 68 will be received in a bevelled section 70 of the respective opening means 67 and have a threaded shank 71 of the fastening member 68 pass through the opening means 67 beyond the lower surface 65 of the respective flange part 66 as illustrated in FIG. 2 and be threadedly received in a cooperating threaded opening means 72 formed in the flange member 27.

There are two threaded opening means 72 formed in the frame member 27 of the frame means 21 so that only two fastening members 68 need be used to fasten the portion 30 to the frame member 27 as the lower surfaces 65 of the two flange parts 66 which will respectively carry the fastening members 68 can rest on flat surface means 73 of the frame member 27 as illustrated in FIG. 2 to subsequently support the entire burner construction 26 in the cooking apparatus 20 as will be apparent hereinafter.

Figure 4:
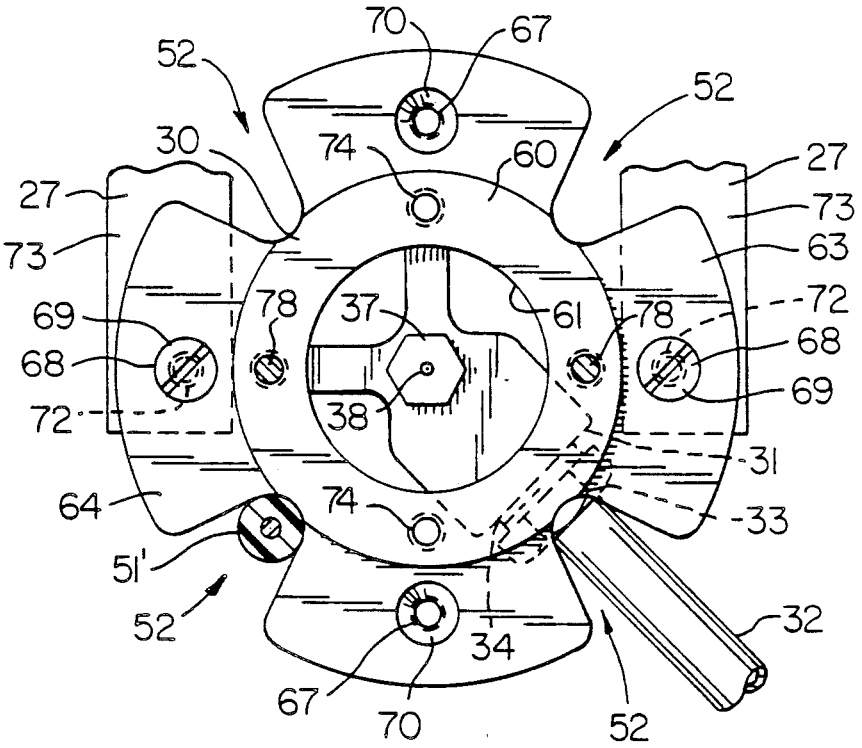
FIG. 4 is a fragmentary cross-sectional view taken on line 4—4 of FIG. 2.
Figure 5:
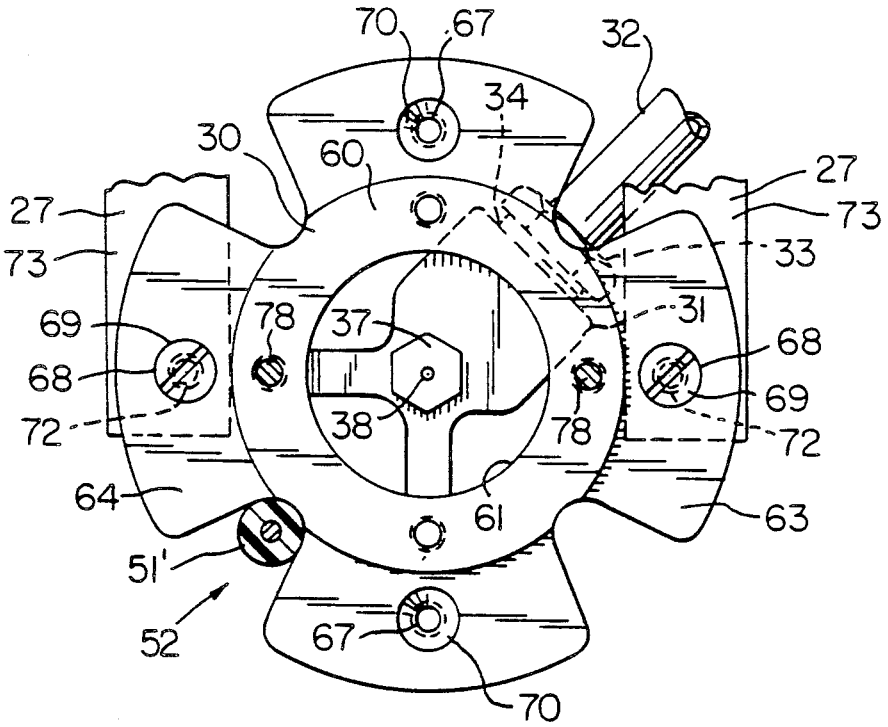
FIG. 5 is a view similar to FIG. 4 and illustrates the burner construction having the second portion thereof disposed in another rotational position thereof relative to the frame means of the cooking apparatus.

In this manner, the two opening means 67 of the portion 30 of the burner construction 26 that is utilized to fasten to the frame member 27 by the fastening members 68 can be so selected that the inlet opening means 34 of the portion 30 can be located in the desired position relative to the cooking apparatus 20 so as to best interconnect with the fuel conduit means 32 regardless of the particular location of the conduit means 32 in a particular apparatus 20, two such selected positions being illustrated respectively in FIGS. 4 and 5.

Thus, it can be seen that there are four different rotational positions that the portion 30 can be mounted to the frame member 27 by the fastening means 68 and each position is disposed approximately 90° relative to the next rotational position that is permitted by the particular arrangement of the flange parts 66 of the portion 30 of the burner construction 26. However, it is to be understood that any desired number of rotational positions can be provided by merely forming more or less like portions 66 in a circular array as previously set forth, if desired.

In this manner, it can be seen that the opening means 67 in the second portion 30 of the burner construction 26 and the opening means 72 in the frame means 21 respectively comprise the second means 58 and 59 previously described.

Similarly, the first means 56 of the first portion 29 of the burner construction 26 comprises a plurality of opening means 74 each being formed through a web-like portion 75 thereof that has an upper surface 76 and a lower surface 77 and through which a threaded fastening member 78 is adapted to have its threaded shank portion 79 pass while an enlarged head 80 thereof abuts against the top surface 76 of the web 75 as illustrated in FIG. 2.

The first means 57 of the second portion 30 of the burner construction 26 comprises a plurality of threaded opening means 81 each of which is adapted to have the threaded portion 79 of the fastening means 78 be threaded therein as illustrated in FIG. 2 to interconnect the portions 29 and 30 together.

Figure 6:
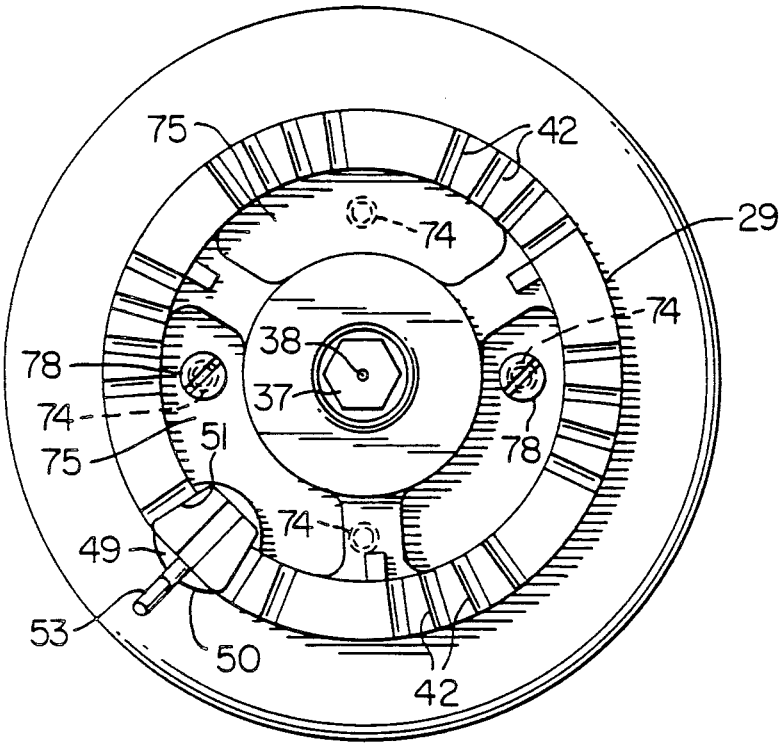
FIG. 6 is a cross-sectional view taken on line 6—6 of FIG. 2.
Figure 7:
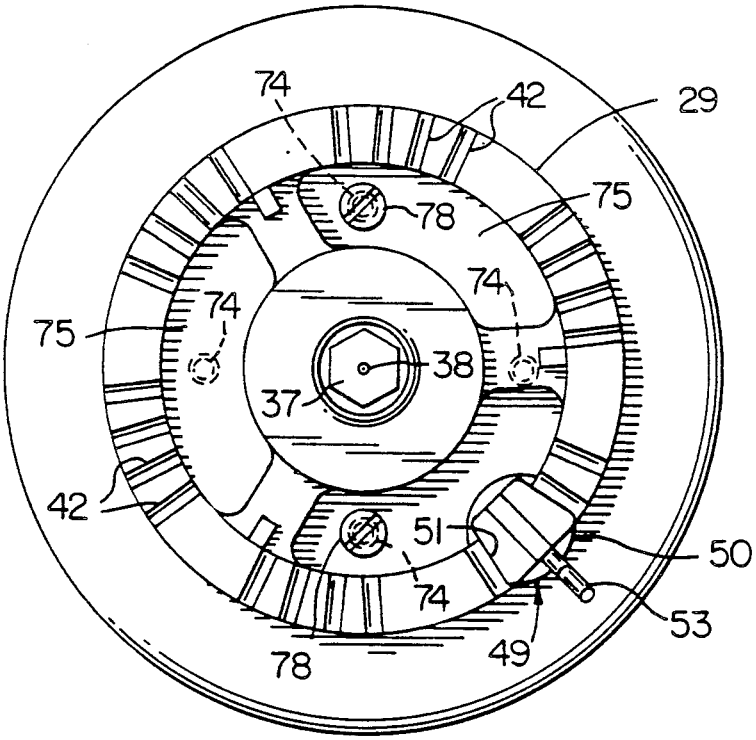
FIG. 7 is a view similar to FIG. 6 and illustrates the burner construction having the first portion thereof disposed in another rotational position thereof relative to the second portion of the burner construction.
Figure 8:
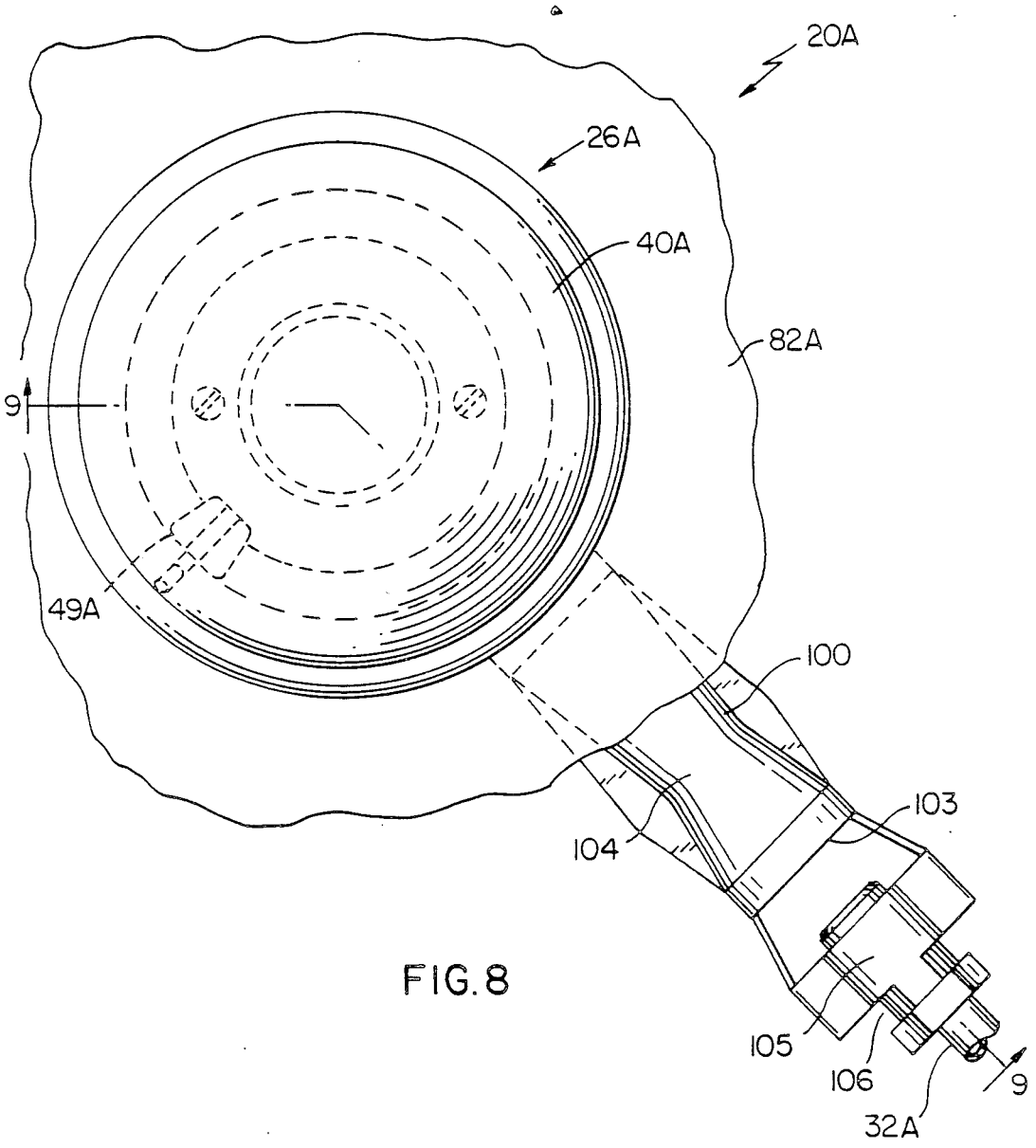
FIG. 8 is a view similar to FIG. 1 and illustrates another new cooking apparatus of this invention utilizing another new burner construction of this invention.

However, as previously stated, the first portion 29 of the burner construction 26 is adapted to be disposed in any one of a plurality of selectable rotational positions relative to the second portion 30 of the burner construction 26 and since there are four opening means 74 disposed in an equally spaced apart circular array and four threaded opening means 81 in the portion 30 likewise disposed in an equally spaced apart circular array that will align with the opening means 74, then the first portion 29 can be disposed in any one of the 90° rotational positions relative to the second portion 30 so that the igniter assembly 49 carried by the first portion 29 can be disposed in different rotational positions as illustrated in FIGS. 6 and 7 for ease of wiring to the electrode 53 thereof for a particular cooking apparatus 20, the projecting part 51' of the igniter assembly 49 fitting in the particular slot means 52 in the flange means 63 of the second portion 30 as previously set forth.

However, before the first portion 29 is secured to the second portion 30, the second portion 30 is first secured to the frame means 21 in the desired rotational position thereof by the fastening members 68 in the manner previously described and then an annular flange means or drip pan 82 is disposed so that an outer peripheral means 83 thereof engages in overlapping relation on the top surface 23 of the top surface means 22 and an inner peripheral means 84 thereof that is recessed below the outer peripheral means 83 is disposed on the top surface means 64 of the flange means 63 of the portion 30 in such a manner that a central opening 85 in the flange means 82 telescopically receives an annular projection 86 defined by the annular surface means 60 of the second portion 30 therein in the manner illustrated in FIG. 2 with the projection 86 having its top surface 87 being disposed substantially flush with the top surface 87' of the inner peripheral means 84 of the flange means 82 as illustrated in FIG. 2.

Thereafter, an annular sealing gasket means 88 is disposed on the surface 87' of the inner peripheral means 84 of the flange means 82 and extends onto the top surface 87 of the projection 86 of the second portion 30 all the way to the opening 61 thereof as illustrated in FIG. 2 so as to be received within an annular recess 89 formed in a lower surface 90 of an outwardly directed annular part 91 of the first portion 29 of the burner body means 28. In this manner, the sealing member 88 will be compressed between the portions 29 and 30 when the threaded fastening means 78 are tightened in place as illustrated in FIG. 2 to provide a fuel seal and contain cooking spillage, the sealing means 88 being formed of any suitable sealing material, such as silicone.

The sealing gasket means 88 has a V-shaped notch means 92 therein that is adapted to cooperate with a notch means 93' in the inner peripheral means 84 of the flange means 82 to permit the projecting portion 51' of the igniter assembly 49 to pass therethrough into a cooperating notch 52 of the second portion 30 of the burner body means 28 for the reasons previously set forth so that suitable electrical wire means (not shown) can be interconnected to the electrode 53 for subsequent ignition purposes.

The sealing gasket 88 also has a pair of openings 93 passing therethrough to permit the threaded fastening members 79 to project through the sealing means 88 to be received in the particular cooperating threaded opening means 81 in the second portion 30 of the burner body means 28 as previously set forth.

Therefore, it can be seen that the burner construction 26 of this invention is adapted to be formed by the method of this invention in a relatively simple manner to be assembled to the frame means 21 of the cooking apparatus 20 by the method of this invention also in a relatively simple manner so as to permit the second portion 30 of the burner body means 28 to be disposed in any one of a plurality of selectable rotatable positions relative to the frame means 21 and then have the first portion 29 of the burner body means 28 disposed in any one of a plurality of selectable rotatable positions relative to the previously fastened portion 30 so as to provide for different installation arrangements on a cooking apparatus.

For example, different first portions 29 can be provided that can be secured to a common second portion 30 that has been secured to the frame means 21. In this manner, different venturi sections 46 can be utilized requiring only a changing of the first portion 29 whereby fewer parts need be stocked for providing different burner constructions.

Also, when it is desired to change an igniter assembly 49, merely removing the first portion 29 from the second portion 30 of the burner construction 26 by first removing the fastening means 78 permits the igniter assembly 49 to be removed with the portion 29 and then have a new igniter assembly 49 replaced in the first portion 29 before the first portion 29 is again assembled to the lower portion 30 that remains secured to the frame means 21.

Therefore, it can be seen that the burner construction 26 of this invention readily permits the lower portion 30 to be properly positioned relative to a fuel supplying conduit means 32 and then have the upper portion 29 thereof properly positioned relative to the lower portion 30 to position the igniter assembly 49 in the best position for subsequent wiring thereto by the assembler of the cooking apparatus 20.

While the first portion 29 of the burner construction 26 previously set forth has a venturi section 46 formed integral and one-piece therewith, it is to be understood that the portion 29 could be provided with a removable venturi section in the same manner as set forth in the aforementioned U.S. Pat. No. 5,002,038 to Riehl.

Also, a venturi arrangement could be provided for the lower portion 30 rather than for the upper portion 29, if desired.

For example, another cooking apparatus of this invention is generally indicated by the reference numeral 20A in FIGS. 8–12 and the parts thereof that are similar to the parts of the cooking apparatus 20 previously described are indicated by like reference numerals followed by the reference letter "A".

As illustrated in FIGS. 8–12, the burner construction 26A for the cooking apparatus 20A does not have a venturi section in the first portion 29A thereof but has a venturi section 46A provided for the second portion 30A and comprising a venturi tube 100 formed of any suitable material, such as metallic material, and having a cylindrical end 101 that is adapted to be disposed in a cylindrical opening 102 in the part 30A as illustrated in the drawings and provided with an inlet end 103 intermediate a necked down venturi part 104 in a manner similar to the inshot burner set forth in the U.S. Pat. No. 5,035,609 to Riehl, whereby this patent is being incorporated into this disclosure by this reference thereto.

In addition, the venturi tube 100 has an orifice retaining part 105 spaced from the inlet end 103 thereof for telescoping onto an end 106 of the fuel conduit 32A to be retained thereon in a manner fully disclosed in the U.S. Pat. No. 3,874,839 to Riehl, whereby this U.S. patent is also being incorporated into this disclosure by this reference thereto.

Therefore, the venturi tube 100 provides the mixing of the fuel and the air before the same are directed to the portion 30A which directly couples to a cylindrical passage 106 in the upper portion 29A to be delivered into the chamber 41A thereof for issuing from the ports 45 in the manner previously set forth for the burner construction 26.

Therefore, it can be seen that the burner construction 26A for the cooking apparatus 20A has the first portion 29A and the second portion 30A thereof formed as separate parts respectively having first means 56A and 57A for interconnecting the same together in any one of a plurality of selectiable rotational positions therebetween with the second portion 30A and the frame means 21A respectively having second means 58A and 59A for interconnecting the same together in any one of a plurality of selectable rotational positions therebetween.

Also, in each of the cooking apparatus 20 and 20A of this invention, it can be seen that the annular flange means 82 or 82A thereof that forms part of the top surface means 22 or 22A thereof is respectively sandwiched between the portions 29, 30 or 29A, 30A to be secured in its assembled position without additional fastening means and readily permits a suitable cooking grate (not shown) to be disposed thereon in the manner fully set forth in the aforementioned U.S. Pat. No. 4,846,671 to Kwiatek.

Figure 9:
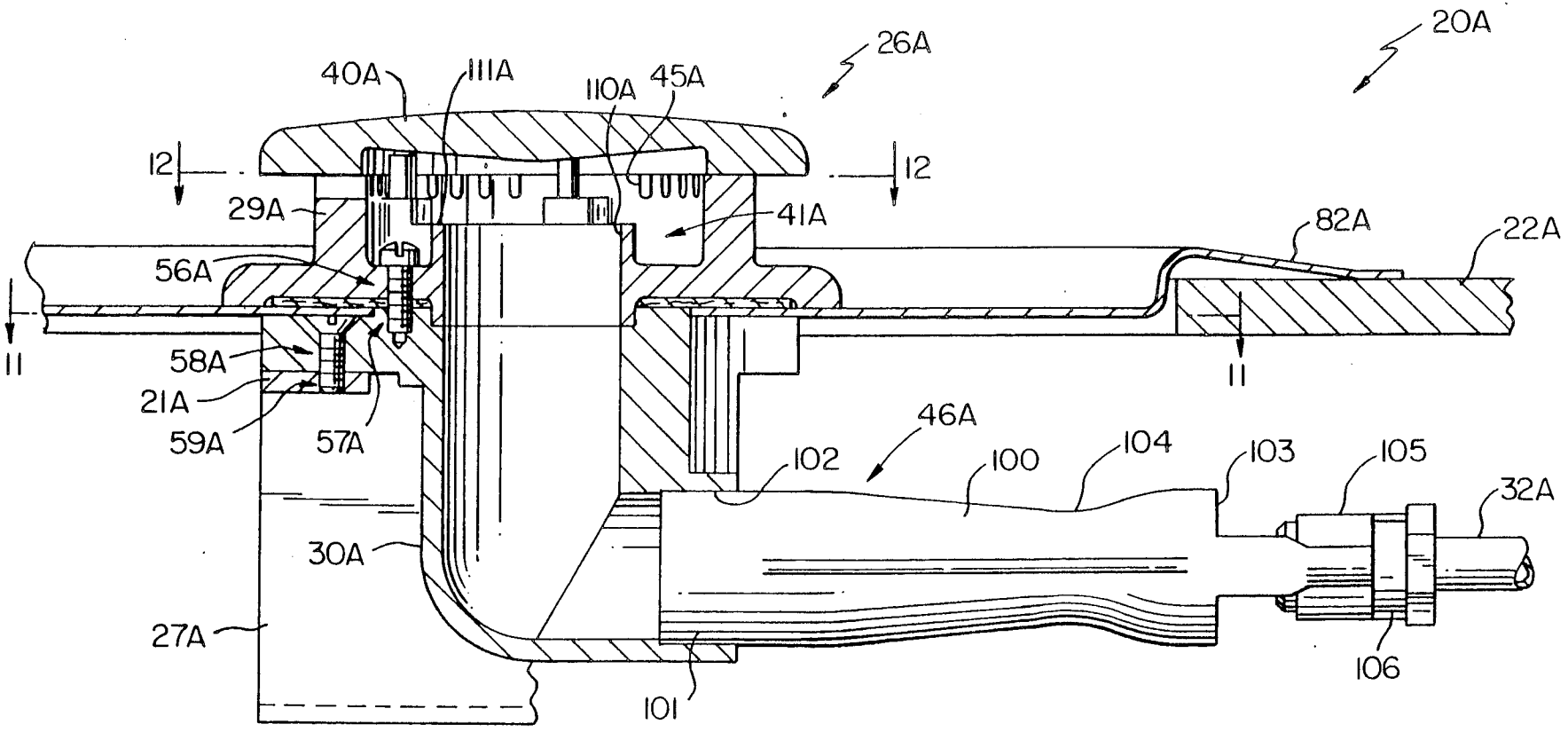
FIG. 9 is an enlarged fragmentary cross-sectional view taken on line 9—9 of FIG. 8.
Figure 10:
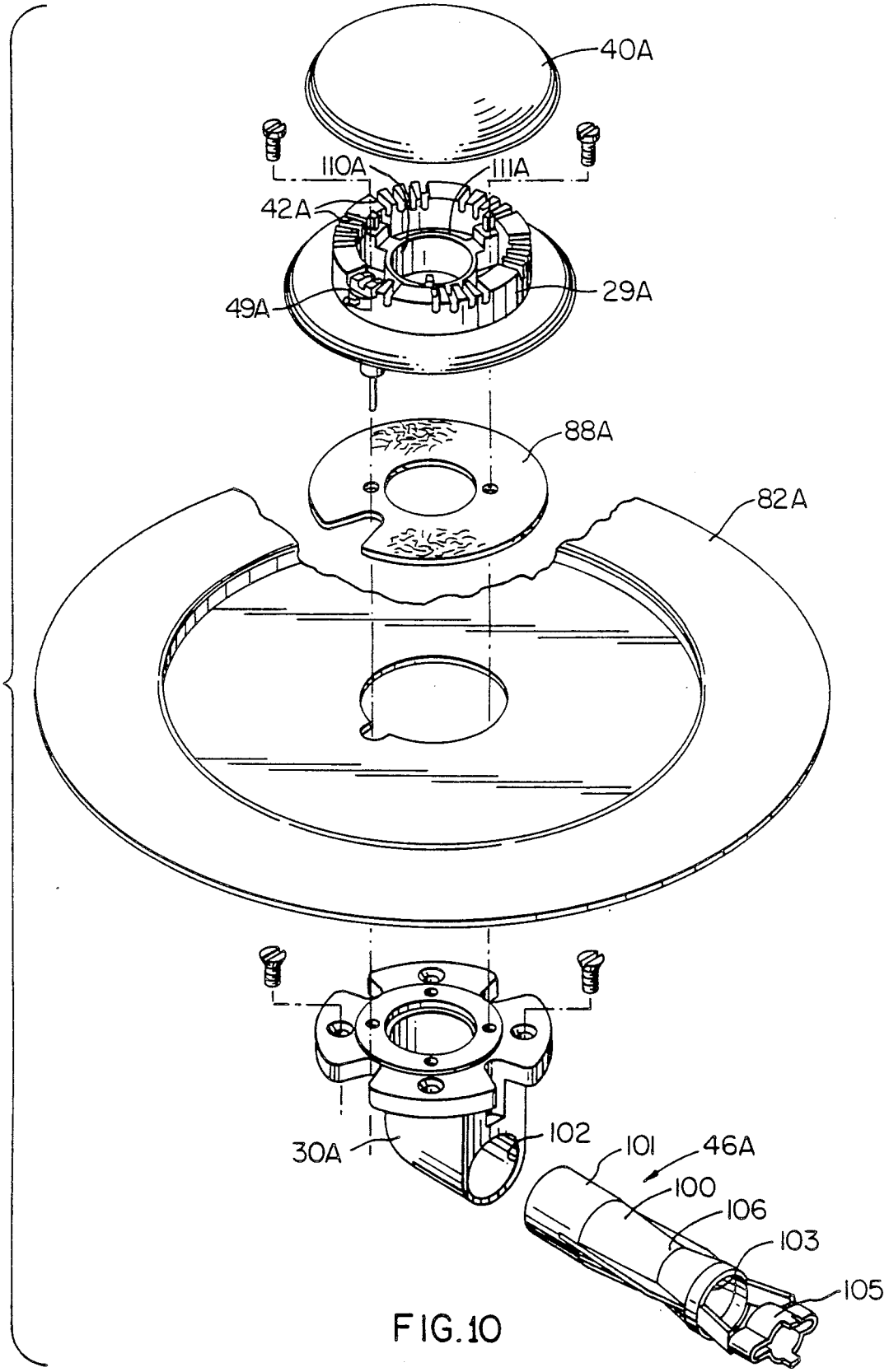
FIG. 10 is an exploded perspective view of the various parts of the burner construction of FIGS. 8 and 9 together with an annular flange means of the cooking apparatus.
Figure 12:
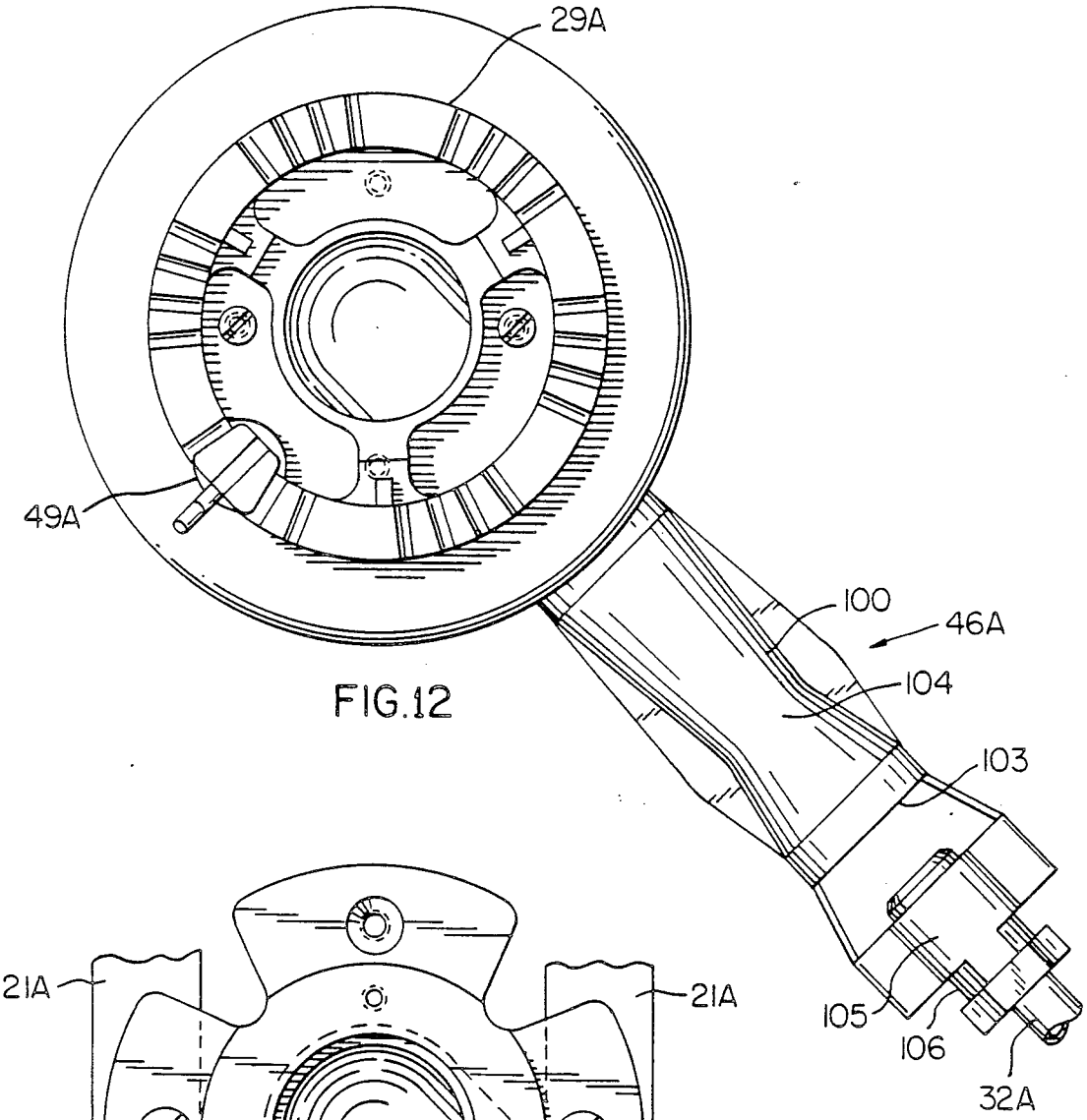
FIG. 12 is a cross-sectional view taken on line 12—12 of FIG. 9
Figure 11:
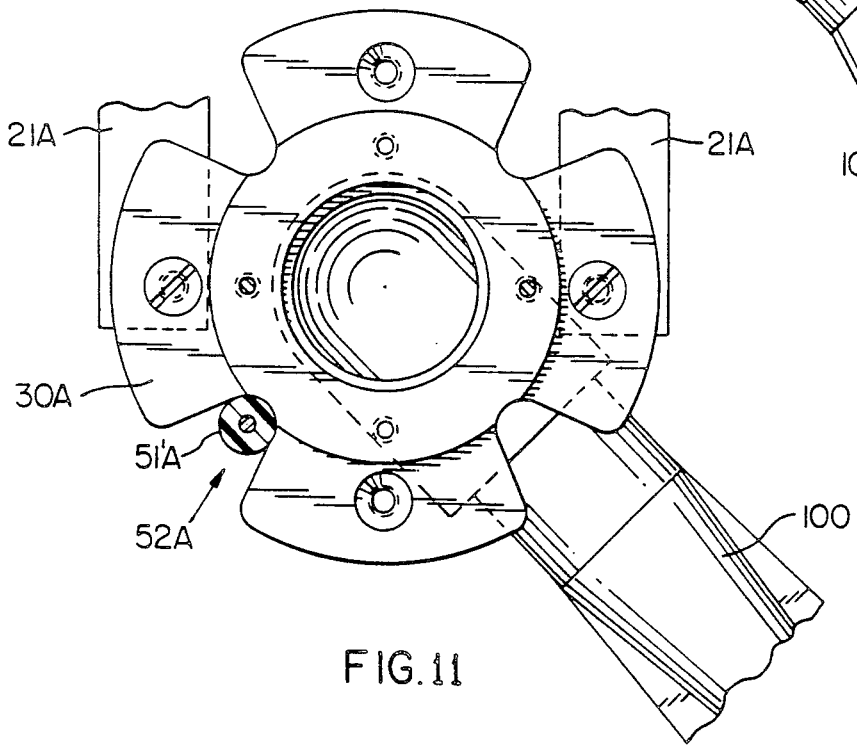
FIG. 11 is a fragmentary cross-sectional view taken on line 11—11 of FIG. 9.
Figure 14:
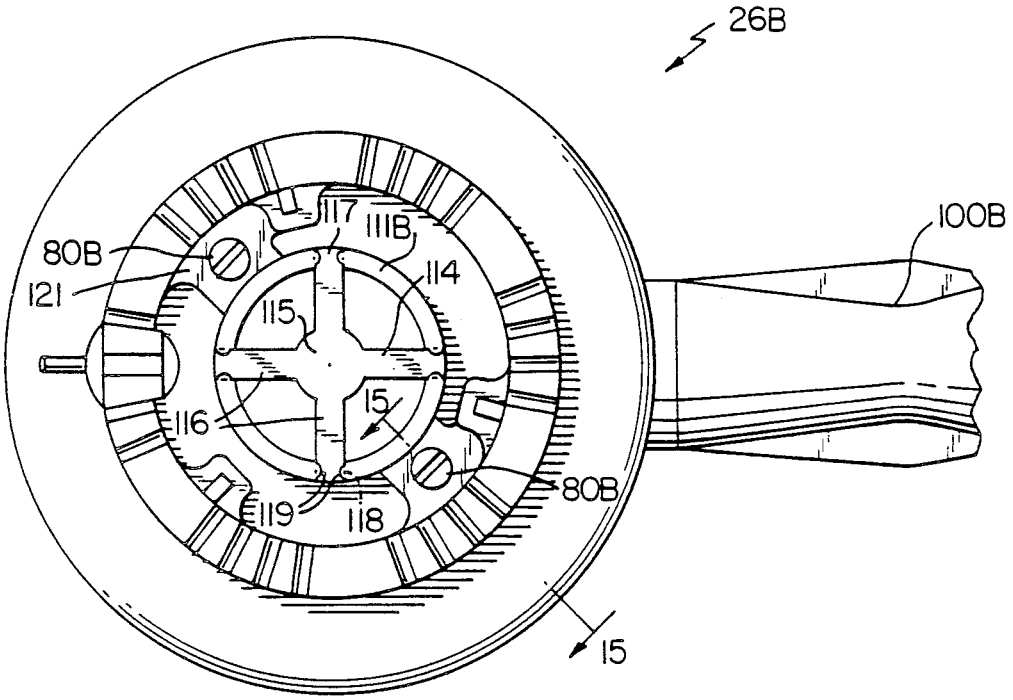
FIG. 14 is a cross-sectional view taken on line 14—14 of FIG. 13 with the top cooking surface means removed.
Figure 13:
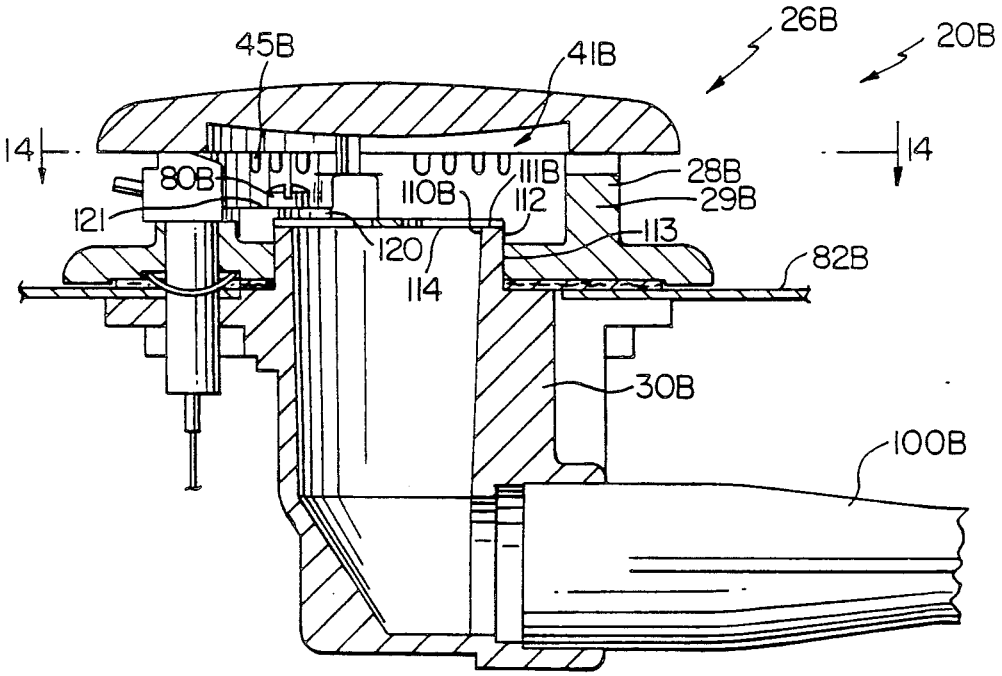
FIG. 13 is a view similar to FIG. 9 and illustrates another new cooking apparatus of this invention utilizing another new burner construction of this invention.
Figure 16:
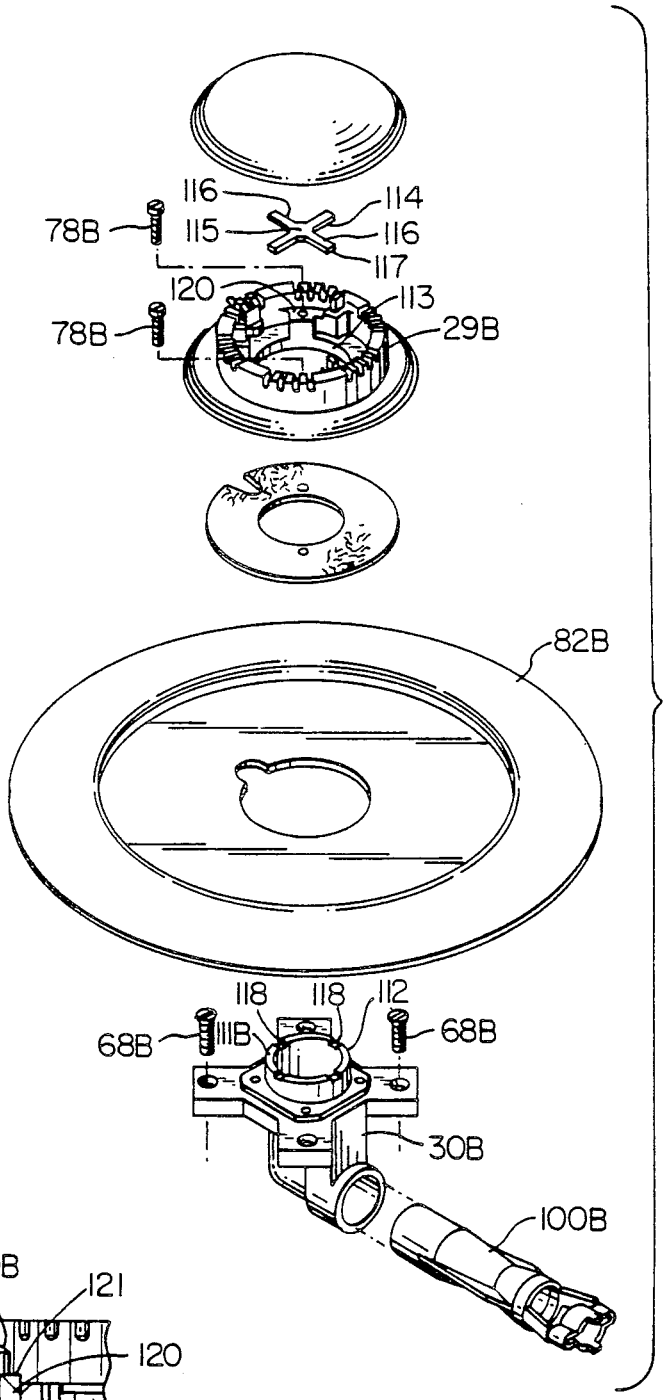
FIG. 16 is an exploded perspective view of the various parts of the burner construction of FIGS. 13 and 14.

It can be seen in FIGS. 2 and 9 that fuel that is passed through the respective venturi means 46 and 46A of the burner constructions 26 and 26A previously described is fed respectively into the chamber means 41 and 41A thereof by passing out of an opening 110 and 110A in an annular surface 111 and 111A of the respective first portions 29 and 29A of the body means 28 and 28A. It was found according to the teachings of this invention that such annular surfaces 111 and 111A can respectively carry plural leg diffusers that will span the respective openings 110 and 110A and that will cause improved mixing of the fuel and minimize flame lifting.

For example, reference is now made to FIGS. 13–16 wherein another cooking apparatus of this invention is generally indicated by the reference numeral 20B and parts thereof similar to the cooking apparatus 20 and 20A previously described are indicated by like reference numerals followed by the reference letter "B".

Figure 15:
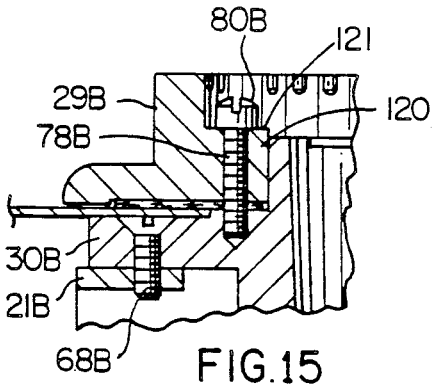
FIG. 15 is a fragmentary cross-sectional view taken on line 15—15 of FIG. 14.

As illustrated in FIGS. 13–16, the cooking apparatus 20B comprises a burner construction 26B and its associated range top drip pan means 82B being secured together with the frame means 21B, FIG. 15, of the cooking apparatus 20B for the reasons and in the manner previously set forth.

The burner body means 28B of the burner construction 26B comprises a first portion 29B and a second portion 30B formed in a manner similar to the portions 29A and 30A of the burner construction 26A previously described except that the second portion 30B has a tubular part 112 projecting through an opening 113 in the first portion 29B so that an upper surface 111B of the tubular part 112 is disposed in the chamber 41B and defines the opening 110B through which the fuel from the venturi tube 100B issues into the chamber 41B to subsequently issue from the port means 45B in the manner previously described.

A flat spider-like diffuser 114, formed of any suitable material, such as metallic material, has a central part 115 and a plurality of legs 116 radiating from the central part 115 and is disposed in a manner to span the opening 110B of the portion 30B and have free ends 117 of the legs 116 thereof secured to the annular surface 111B in any suitable manner, such as by being received in suitable recesses 118 formed in the surface 111B and having the surface 111B peened over at 119 to hold the diffuser 114 in place.

As previously stated, the burner constructions 26 and 26A previously described can also have diffusers 114 secured to the respective surfaces 111 and 111A thereof in a similar manner if such diffusers 114 are to be utilized therewith, as desired.

Thus, it can be seen that the central part 115 of the diffuser 114 of the burner construction 26B can comprise a circular structure that is coaxially disposed relative to the opening 110B and the legs 116 that radiate therefrom and span the remaining space of the opening 110B between the central part 115 and the annular surface 111B to permit the fuel to pass between the legs 116 and out of the opening 110B while the restriction to the flow to the fuel by the legs 116 and the central part 115 create a turbulence to the fuel flow out of the opening 110B to enhance the mixing thereof for the reasons previously set forth. Of course, the diffuser 114 can have other configurations, if desired, such as any desired number of legs 116, etc., to suit the combustion need.

It can be seen that the burner construction 26B includes the fastening members 68B for fastening the second portion 30B of the body means 28B to the frame means 21B in a desired rotational position as illustrated in FIG. 15 and in the manner previously set forth and that the first portion 29B can be secured in the desired rotational position to the thus fastened lower portion 30B by the fastening members 78B in the manner previously set forth.

However, it can also be seen that the first portion 29B of the body means 28B of the burner construction 26B has raised webs or sections 120 through which the fastening members 78B must pass so that the enlarged heads 80B of the fastening member 78B will engage against surfaces 121 thereof which are raised above the surface 111B of the lower portion 30B as fully illustrated in FIG. 15. It is found that by raising the surfaces 121 of the first portion 29B above the surface 111B of the second portion 30B when the portions 29B and 30B are being assembled together, a power screwdrive assembly can be readily utilized for fastening the fastening members 78B in place whereas having the heads 80 of the threaded fastening members 78 being disposed below the surface 111 as illustrated in FIG. 2, it is relatively difficult to insert a power screwdriver into the space that is provided between the annular surfaces 111 and 39 for the burner construction 26 previously described.

Nevertheless, it can be seen that the resulting burner construction 26B readily permits the lower portion 30B to be disposed in the desired rotational position relative to the cooking apparatus 20B and be fastened thereto by the fastening means 68B and then have the upper portion 29B disposed in the desired rotational position relative to the fastened surface lower portion 30B and be fastened thereto by the fastening means 78B all in the manner previously set forth.

Additionally, it can be seen that the diffuser 114 can be optionally utilized with the second portion 30B of the burner construction 26B as desired.

Since the operation of the burner construction 26B is substantially the same as the burner construction 26 and 26A previously set forth, a further discussion of the operation of the burner construction 26B is thus deemed unnecessary.

Therefore, it can be seen that this invention not only provides a new cooking apparatus and a new burner construction for such a cooking apparatus, but also this invention provides new methods of making such a new cooking apparatus and such a new burner construction.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a cooking apparatus comprising a frame means having a top surface means provided with an opening means passing therethrough, and a burner construction carried by said frame means so that said burner construction projects out of said opening means above said top surface means, said burner construction comprising a first portion that extends above said top surface means, said first portion having a chamber means therein and having port means out of which fuel can issue from said chamber means to burn externally to said first portion above said top surface means, said burner construction comprising a second portion that extends below said top surface means and has means for interconnecting with a fuel source conduit means and for delivering fuel therefrom to said chamber means, the improvement wherein said first portion and said second portion are separate parts respectively having first means interconnecting the same together in one of a plurality of selectable rotational positions therebetween and wherein said second portion and said frame means respectively have second means interconnecting the same together in one of a plurality of selectable rotational positions therebetween.

2. A cooking apparatus as set fort in claim 1 wherein said burner construction comprises an igniter assembly carried by said first portion so as to be movable in unison therewith relative to said second portion.

3. A cooking apparatus as set forth in claim 1 where said burner construction comprises a venturi means disposed between said chamber means and said conduit means.

4. A cooking apparatus as set forth in claim 3 wherein said venturi means is carried by said first portion so as to be movable in unison therewith relative to said second portion.

5. A cooking apparatus as set forth in claim 3 wherein said venturi means is carried by said second portion so as to be movable in unison therewith relative to said frame means.

6. A cooking apparatus as set forth in claim 1 wherein said plurality of selectable rotatable positions between said first portion and said second portion comprise four such positions each being approximately 90° from the next adjacent position.

7. A cooking apparatus as set forth in claim 1 wherein said plurality of selectable rotatable positions between said second portion and said frame means comprise four such positions each being approximately 90° from the next adjacent position.

8. A cooking apparatus as set forth in claim 1 wherein said burner construction comprises a removable cap means, said first portion having an open end that leads to said chamber means, said cap means removably closing said open end when said cap means is disposed on said first portion in a certain position thereon, said first means of said first portion being accessible through said open end when said cap means is removed therefrom.

9. A cooking apparatus as set forth in claim 1 and comprising an annular flange means disposed on said top surface means and bridging the space of said opening means thereof between said burner construction and said top surface means, said flange means having an inner peripheral means held between said first portion and said second portion of said burner construction whereby said burner construction provides the sole securement for retaining said flange means on said top surface means.

10. A cooking apparatus as set forth in claim 9 and comprising an annular sealing means disposed between said first portion and said second portion to seal the same together.

11. In a burner construction for a cooking apparatus comprising a frame means having a top surface means provided with an opening means passing therethrough, said burner construction being adapted to be carried by said frame means so that said burner construction projects out of said opening means above said top surface means, said burner construction comprising a first portion that is adapted to extend above said top surface means, said first portion having a chamber means therein and having port means out of which fuel can issue from said chamber means to burn externally to said first portion above said top surface means, said burner construction comprising a second portion that is adapted to extend below said top surface means and has means for interconnection with a fuel source conduit means and for delivering fuel therefrom to said chamber means, the improvement wherein said first portion and said second portion are separate parts respectively having first means adapted to interconnect the same together in any one of a plurality of selectable rotational positions therebetween and wherein said second portion and said frame means respectively have second means adapted to interconnect the same together in any one of a plurality of selectable rotational positions therebetween.

12. A burner construction as set forth in claim 11 wherein said burner construction comprises an igniter assembly carried by said first portion so as to be movable in unison therewith relative to said second portion.

13. A burner construction as set forth in claim 11 wherein said burner construction comprises a venturi means adapted to be disposed between said chamber means and said conduit means.

14. A burner construction as set forth in claim 13 wherein said venturi means is carried by said first portion so as to be movable in unison therewith relative to said second portion.

15. A burner construction as set forth in claim 13 wherein said venturi means is carried by said second portion so as to be adapted to be movable in unison therewith relative to said frame means.

16. A burner construction as set forth in claim 11 wherein said plurality of selectable rotatable positions between said first portion and said second portion comprise four such positions each being approximately 90° from the next adjacent position.

17. A burner construction as set forth in claim 11 wherein said plurality of selectable rotatable positions between said second portion and said frame means comprise four such positions each being approximately 90° from the next adjacent position.

18. A burner construction as set forth in claim 11 wherein said burner construction comprises a removable cap means, said first portion having an open end that leads to said chamber means, said cap means removably closing said open end when said cap means is disposed on said first portion in a certain position thereon, said first means of said first portion being accessible through said open end when said cap means is removed therefrom.

19. In a method of making a cooking apparatus comprising a frame means having a top surface means provided with an opening means passing therethrough, and a burner construction carried by said frame means so that said burner construction projects out of said opening means above said top surface means, said burner construction comprising a first portion that extends above said top surface means, said first portion having a chamber means therein and having port means out of which fuel can issue from said chamber means to burn externally to said first portion above said top surface means, said burner construction comprising a second portion that extends below said top surface means and has means for interconnecting with a fuel source conduit means and for delivering fuel therefrom to said chamber means, the improvement comprising the steps of forming said first portion and said second portion to be separate parts respectively having first means interconnecting the same together in one of a plurality of selectable rotational positions therebetween, and forming said second portion and said frame means to respectively have second means interconnecting the same together in one of a plurality of selectable rotational positions therebetween.

20. In a method of making a burner construction for a cooking apparatus comprising a frame means having a top surface means provided with an opening means passing therethrough, said burner construction being adapted to be carried by said frame means so that said burner construction projects out of said opening means above said top surface means, said burner construction comprising a first portion that is adapted to extend above said top surface means, said first means having a chamber means therein and having port means out of which fuel can issue from said chamber means to burn externally to said first portion above said top surface means, said burner construction comprising a second portion that is adapted to extend below said top surface means and has means for interconnecting with a fuel source conduit means and for delivering fuel therefrom to said chamber means, the improvement comprising the steps of forming said first portion and said second portion to be separate parts respectively having first means adapted to interconnect the same together in any one of a plurality of selectable rotational positions therebetween, and forming said second portion and said frame means to respectively have second means adapted to interconnect the same together in any one of a plurality of selectable rotational positions therebetween.

* * * * *